United States Patent [19]

Hudson et al.

[11] 4,146,987

[45] Apr. 3, 1979

[54] IMPULSE ACTIVATED COUNTING DEVICE

[75] Inventors: Colin M. Hudson, Moline; William L. Andre, Ben Lomond, both of Calif.

[73] Assignee: The United States of America as represented by the Secretary of the Army, Washington, D.C.

[21] Appl. No.: 737,867

[22] Filed: Nov. 1, 1976

[51] Int. Cl.[2] ..... G06M 1/00; F41F 27/00

[52] U.S. Cl. ..... 42/1 E; 235/91 R; 235/91 H

[58] Field of Search ..... 42/1 E; 235/91 R, 91 H; 89/1; 346/38

[56] References Cited

U.S. PATENT DOCUMENTS

| | | | |
|---|---|---|---|
| 1,150,756 | 8/1915 | Gocke | 41/1 E |
| 1,324,098 | 12/1919 | Arter | 42/1 E |
| 1,382,913 | 6/1921 | Hodge et al. | 235/91 H |
| 1,479,138 | 1/1924 | Hazelton | 42/1 E |
| 1,624,219 | 4/1927 | Cowdrey | 235/91 H |
| 2,207,204 | 7/1940 | Peyton et al. | 235/91 H |
| 3,130,906 | 4/1964 | Fischer | 235/91 R |

FOREIGN PATENT DOCUMENTS

| | | | |
|---|---|---|---|
| 137645 | 1/1920 | United Kingdom | 42/1 E |

*Primary Examiner*—Stephen J. Tomsky

*Attorney, Agent, or Firm*—Nathan Edelberg; Robert O. Richardson

[57] ABSTRACT

Method and apparatus for actuating a counting device for recording and storing data. The invention comprises an activator for a counter device and includes a mass or weight having an eccentric center of mass which is freely pivotable in one plane in response to an externally applied impulse force of a predetermined magnitude to apply a torque force to a shaft which, on rotation thereof under the influence of said torque force, activates the counter mechanism to record a count. Means are also provided to apply counter torque force of a constant predetermined magnitude or value to the shaft so that the counting device is actuated only in response to a resultant torque force of a predetermined magnitude or value generated by the impulse.

6 Claims, 1 Drawing Figure

IMPULSE ACTIVATED COUNTING DEVICE

GOVERNMENT RIGHTS

The invention described herein may be manufactured and/or used by or for the Government for governmental purposes without the payment of any royalty thereon.

BACKGROUND OF THE INVENTION

Counting devices of the prior art have exhibited certain drawbacks functionally, particularly where the counter operates in an environment requiring ruggedization of the counter such as the counters used to record the number of rounds fired from large-caliber weapons systems.

Counters such as that disclosed in Fischer U.S. Pat. No. 3,130,906 incorporate numerous movable parts which would be subject to substantial shock forces produced by the recoil parts of such a weapon system. Temperature extremes to which such weapon systems are exposed would require recalibration of the counter assembly of Fischer type devices. Altitude or elevation orientation of the weapon system gun tube would also be a factor in a determination of whether recalibration of the counter device is required.

Other counter devices, such as that disclosed in Webb U.S. Pat. No. 2,354,079, operate in response to the relative movement of the moving parts of the weapon system and, thus, would become a limitation or parameter of the weapon design. Repair and replacement then become an additional problem in the possible utilization of such prior art counter devices.

SUMMARY OF THE INVENTION

By utilization of the present invention, these problems and difficulties, among others, of the prior art are substantially overcome by the provision of a counter device which includes a weight or mass having an eccentric center of mass which is freely pivotable to oscillate in one plane in response to the application thereto of an external force impulse of a predetermined magnitude. Such motion of the mass is employed to rotate the shaft of a conventional mechanical counter device to record a count. Means are also provided to insure that the shaft does not actuate a count, unless the torque force applied to the shaft by the mass reaches a predetermined threshold level of magnitude or value. Such means apply a relatively constant counter-torque force of a predetermined magnitude to the counter actuator shaft so that the shaft actuates a count only when the resultant torque force on the shaft generated by the moving mass reaches a certain level of magnitude sufficient to overcome the counter torque force applied by such means.

The present invention provides a counter actuator device which is simple and rugged in construction, has a minimum number of movable parts, is relatively temperature insensitive, does not require recalibration when moved from one location to another, is operative in many positions of angularity, is easily adapted for use with existing commercial mechanical counter mechanisms, is attachable to and not part of the parts whose movement is being counted, and minimizes the possibility of human error by automatic recordation of the number of movements of said parts.

DESCRIPTION OF THE PREFERRED EMBODIMENT

Figure 1:
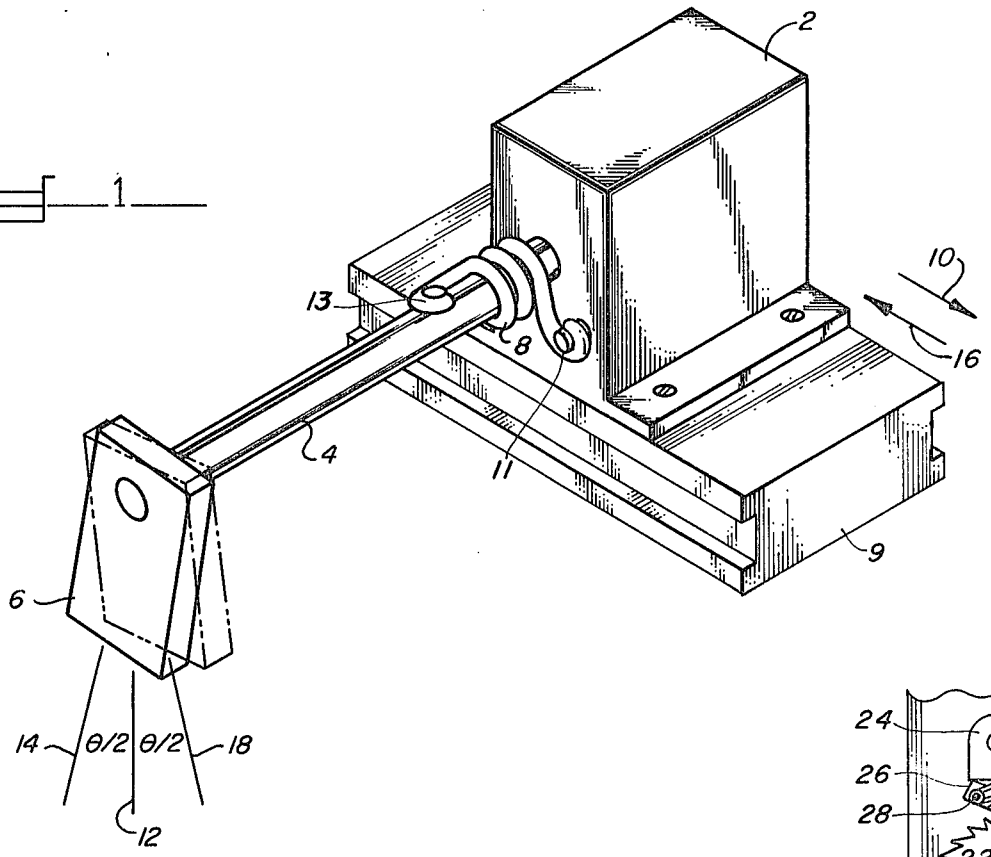
FIG. 1 is a schematic view in perspective of a preferred embodiment of the present invention.

Referring to FIG. 1, there is shown a conventional mechanical digital counter 2 having a rotatable actuator shaft 4 for sequentially actuating a plurality of counts by the counter 2. Such a counter may be similar to that shown in the Fischer patent previously mentioned. A properly selected weighted mass 6 is shown fixedly mounted to the end of the shaft 4 opposite the counter 2. The counter 2 is attached to a body 9 which applies the force to mass 6 by its movement.

The mass 6 is so mounted as to exhibit an eccentric center of mass to permit angular pivoting movement of the mass 6 in a single plane in response to the application of an external impulse force thereto. When an impulse force is applied to the weighted mass 6, pivoting movement of the mass transmits a torque force to the shaft and thereby rotates the shaft. Rotation of the shaft to a certain angularity or degree of rotation actuates the counter to record a count. Successive forces above a predetermined magnitude in opposite directions is required to "cock," then "click" the counter in a two step sequence.

In order to assure that the shaft does not actuate a count unless the amplitude of the impulse applied to the mass 6 exceeds a predetermined threshold value, a preset constant counter torque or shaft rotation force is applied to the shaft 4. For this purpose a preloaded spring means 8 is coiled about the shaft 4 and connected to the counter at one end 11 and bears at its other end 13 against the shaft 4. The threshold impulse value is selected depending upon the impulse function which is to be counted. Appropriate threshold values of impulse to produce a count are established by the amount of preloading of the spring 8 and the torsional spring constant of the spring. Changes in spring characteristic will effect the reaction of the impulse weight to the applied impulse.

To maximize the impulse range of the counter and thereby establish an increased scope of application of the counter to a variety of different impulse generating devices, an adjustable mechanical limit catch (not shown) may be included in the counter assembly.

This invention is particularly adaptable for use as a counter for counting the number of rounds fired by large caliber guns, such as howitzers. The impulse force vector is a function of the time displacement of the gun launcher and can be described by the acceleration versus time characteristic of the recoiling parts of the gun during firing. The impulse force vector opposing forces are the inertia forces of the calibrated mass, the internal inertia forces of the counter mechanism, and the resistive spring force of the preloaded spring.

In order to prevent the counter from making a count, if the gun parts slam into battery position without the gun having been fired, such as in exercising the gun to maintain recoil sealing and lubricating characteristics, a preset angle of movement of the mass 6 is established in a direction so that a count is recorded and is achieved only as the gun recoil parts are returning to in battery position after the gun has been fired.

Thus, when the counter 2 is attached to a gun recoil part 9 so that it first moves rearwardly in the direction of arrow 10, the impulse weight moves its longitudinal axis from position 12 to its position 14. This rotates shaft 4 to "cock" the counter 2 preparatory to initiating a click or count. The subsequent counterrecoil movement of the gun part 9 as it moves to battery position moves the counter 2 forward in the direction of arrow 16 to move the weight 6 relatively rearwardly so its longitudinal axis is in position 18. This "clicks" the counter 2 to register a count and the weight then returns to its original position 12.

It should be noted that the counter counts only if the weight has gone through the two steps above mentioned. If the gun has not fired but is released from its battery position, the recoil force is not great enough to move the weight to position 14 to "cock" the counter. Thus, the aforementioned exercising of the gun to lubricate and maintain sealing of the parts will not register a count.

Figure 2:
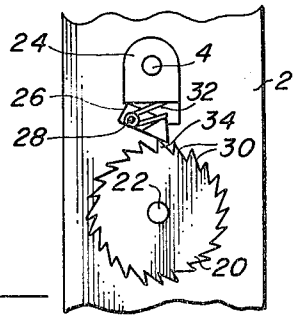
FIG. 2 is an elevational view partially in section illustrating the counter ratchet responsive to successive forces in opposing directions.

FIG. 2 illustrates how the counter ratchet is made responsive to these successive opposing forces requiring both a recoil and counter-recoil force to register a count but not otherwise. Here is shown the inside wall of counter 2 on which a ratchet wheel 20 is mounted through shaft 22. Shaft 4, which is rotated by mass 6 in FIG. 1, when subjected to impulse forces, also pivots on the wall of counter 2 and has a support bracket 24 attached thereto and rotatable thereby. A toggle 26 is pivotally mounted at 28 to bracket 24 and is urged downwardly into engagement with ratchet teeth 30 by torsion spring 32.

As shown in FIG. 2, toggle 26 bears on the inclined surface of tootn 34 with enough force from spring 32 to resist incidental rotation of the ratchet wheel 20. If a sufficient recoil force in the direction of arrow 10 in FIG. 1 is applied, shaft 4 rotates in a clockwise direction and toggle 26 moves to the left to engage the vertical surface of tooth 34. This is the cocking motion of the counter. A subsequent impulse in the direction of arrow 16 in FIG. 1 rotates shaft 4 counterclockwise, moving toggle 26 from left to right in FIG. 2. This second movement completes the ratchet wheel rotation and a count is registered. Now, assume the gun was not fired but merely released from its battery position. In this case toggle 26 would not engage the vertical surface of tooth 34 and rotate the ratchet wheel. Instead, when the in-battery impulse force was applied, toggle 26 would move from left to right over the inclined surface of tooth 34 and no count would be registered.

It can thus be seen that when gun recoil part 9 moves in direction of arrow 10 with sufficient force to rotate mass 6 from position 12 to position 14, shaft 4 rotates clockwise, as does bracket 24 and toggle 26. This moves toggle 26 to the left in FIG. 2 so that the toggle engages the vertical surface of tooth 34. This "cocks" the counter. Now when gun recoil part 9 moves forward in the direction of arrow 16, mass 6 swings to position 18, rotating shaft 4, bracket 26 and toggle 28 in a counterclockwise direction. This rotation causes ratchet wheel 20 and shaft 22 to rotate clockwise, or advance the distance of one tooth 30. This 'clicks' or completes the movement required for counter 2 to recognize and add a count of one numeral.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. An impulse activated counting device including:

a weight having an eccentric center of mass mounted for free pivoting movement in response to application of an external impulse force of a predetermined magnitude in either of two directions, a rotatable shaft having said weight connected thereto and reactable to pivoting movement of said mass when said impulse forces are applied, said shaft being connected to a counter mechanism of said counting device to activate said counter mechanism when successive impulse forces in both directions have been applied, and, means resiliently interconnecting said shaft with said counting device for controlling the degree of rotational motion of said shaft in response to pivoting movement of said weight.

2. The device of claim 1 wherein said weight is carried at one end of the shaft and said control means is spring means carried at the opposite end of said shaft.

3. The device of claim 1 wherein said mass rotates said shaft in one direction when said impulse force is in the opposite direction, said means returns said shaft to its original or neutral position, and a second impulse force in the opposite direction from said first impulse force rotates said shaft in a direction opposite to that direction of first shaft rotation.

4. The device of claim 3 wherein said counting device does not register a count until both said first and said second impulse forces have been applied.

5. The device of claim 3 wherein said counting device registers a count after said first and said second impulse forces have been applied.

6. An impulse activated counting device for attachment to a gun recoil part to register a count when a gun has fired, the part has recoiled and then returned to battery position, said device comprising:

a counter mounted on a gun recoil part with its rotary shaft at a right angle to the direction of gun recoil movement, an eccentric weight fixedly attached to said shaft, a spring connecting said shaft to said counter to resist rotation of said shaft, the reaction characteristics of said spring and said weight being such that the recoil of said gun when fired causes said counter to cock and the counterrecoil of said gun completes a count by said counter.

* * * * *

UNITED STATES PATENT AND TRADEMARK OFFICE

CERTIFICATE OF CORRECTION

PATENT NO. : 4,146,987

DATED : April 3, 1979

INVENTOR(S) : Colin M. Hudson et al.

It is certified that error appears in the above-identified patent and that said Letters Patent are hereby corrected as shown below:

On the title page, item [75] Inventors:

should read -- Colin M. Hudson, Moline, Ill.;
William L. Andre, Ben Lomond, Calif. --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*